US008528690B1

(12) United States Patent
Wu

(10) Patent No.: US 8,528,690 B1
(45) Date of Patent: Sep. 10, 2013

(54) SOUND EFFECT AMPLICATION DIFFUSER

(71) Applicant: Chen-Source Inc., Taoyuan County (TW)

(72) Inventor: Chen-Yun Wu, New Taipei (TW)

(73) Assignee: Chen-Source Inc., Guishan Township, Taoyuan County (TW)

( * ) Notice: Subject to any disclaimer, the term of this patent is extended or adjusted under 35 U.S.C. 154(b) by 0 days.

(21) Appl. No.: 13/751,403

(22) Filed: Jan. 28, 2013

(51) Int. Cl.

| | |
|---|---|
| ***G10K 11/02*** | (2006.01) |
| ***G10K 11/22*** | (2006.01) |
| ***H04R 1/30*** | (2006.01) |
| ***H04R 1/34*** | (2006.01) |
| *G10K 11/00* | (2006.01) |
| *H04R 1/20* | (2006.01) |
| *H04R 1/32* | (2006.01) |

(52) U.S. Cl.
USPC ..... 181/179; 181/199; 181/152; 381/349; 381/340; 381/338

(58) Field of Classification Search
USPC ..... 181/179, 199, 152, 156; 381/305, 381/345, 349, 340, 338, 339, 337; 361/679.09, 361/679.02
See application file for complete search history.

(56) References Cited

U.S. PATENT DOCUMENTS

| | | | | |
|---|---|---|---|---|
| 1,304,308 | A * | 5/1919 | Gransaull | 379/449 |
| 3,443,661 | A * | 5/1969 | Van Sciver | 181/199 |
| 3,952,159 | A * | 4/1976 | Schott | 381/349 |
| 5,689,574 | A * | 11/1997 | Heirich et al. | 381/354 |
| 5,703,946 | A * | 12/1997 | Chen | 379/446 |
| 5,825,900 | A * | 10/1998 | Jeon | 381/339 |
| 6,012,542 | A * | 1/2000 | Accordino | 181/199 |
| 6,349,792 | B1 * | 2/2002 | Smith et al. | 181/156 |
| 6,520,282 | B1 * | 2/2003 | Hadzic et al. | 181/199 |
| 6,560,343 | B1 * | 5/2003 | Kim | 381/349 |
| 6,955,241 | B2 * | 10/2005 | Thorsell et al. | 181/156 |
| 7,296,653 | B1 * | 11/2007 | Smith et al. | 181/155 |
| 7,630,491 | B1 * | 12/2009 | Uyehara | 379/433.02 |
| 7,778,431 | B2 * | 8/2010 | Feng et al. | 381/160 |
| 7,789,192 | B2 * | 9/2010 | Barrios et al. | 181/156 |
| 8,086,285 | B2 * | 12/2011 | McNamara et al. | 455/575.1 |
| 8,256,568 | B2 * | 9/2012 | Lin | 181/179 |
| 8,320,597 | B2 * | 11/2012 | Griffin et al. | 381/339 |
| 8,327,974 | B1 * | 12/2012 | Smith et al. | 181/175 |
| 8,412,289 | B1 * | 4/2013 | Oh | 455/575.1 |
| 8,428,665 | B1 * | 4/2013 | McLaughlin et al. | 455/575.1 |
| 2002/0009195 | A1 * | 1/2002 | Schon | 379/454 |
| 2007/0223745 | A1 * | 9/2007 | Feng et al. | 381/160 |
| 2010/0183170 | A1 * | 7/2010 | Shen et al. | 381/120 |
| 2010/0219012 | A1 * | 9/2010 | Baumbach | 181/177 |
| 2011/0170725 | A1 * | 7/2011 | Liu | 381/338 |
| 2011/0199727 | A1 * | 8/2011 | Probst | 361/679.09 |

(Continued)

*Primary Examiner* — Edgardo San Martin
(74) *Attorney, Agent, or Firm* — Muncy, Geissler, Olds & Lowe, PLLC

(57) ABSTRACT

A sound effect amplification diffuser includes a deck including a cover member defining a top bearing space, a sound collection hole at one lateral side of the bearing space, a sound collecting hood at the bottom side thereof around the sound collection hole and a sound grille at one side wall thereof opposite to the sound collection hole, a base member affixed to the bottom side of the cover member and an accommodation chamber defined between the base member and the cover member, and an amplification diffuser suspending in the accommodation chamber and connected between the sound collecting hood and the sound grille and adapted to enhance the intensity of the output sound of a mobile electronic device being positioned in the bearing space.

6 Claims, 7 Drawing Sheets

(56) References Cited

U.S. PATENT DOCUMENTS

2012/0027237 A1* 2/2012 Lin ..... 381/340
2012/0106062 A1* 5/2012 Probst et al. ..... 361/679.09
2012/0140970 A1* 6/2012 Kim et al. ..... 381/340
2012/0303146 A1* 11/2012 Genov et al. ..... 700/94

* cited by examiner

SOUND EFFECT AMPLICATION DIFFUSER

BACKGROUND OF THE INVENTION

1. Field of the Invention

The present invention relates to mobile electronic device holder technology and more particularly, to a sound effect amplification diffuser, which is a combination of a deck for holding a mobile electronic device and an amplification diffuser for enhancing the intensity of the output sound of the mobile electronic device being carried in the deck.

2. Description of the Related Art

With fast development of electronic technology, many different advanced mobile electronic devices have been created and have appeared in the market to bring. These advances mobile electronic devices are so smart and can do many things. Through the internet, people may use a computer to help office work or home study, and to do may other works such as word processing, statistical computing and graphics, image processing, audio and video playback, query information, shopping, chat and other functions and processing. Because the computer brings convenience to people, it has become an integral part of our lives. Nowadays, iPad and other tablet computers and smart phones are intensively used by people everywhere. A mobile electronic device has built therein a speaker for voice output. However, due to space limitation, the capacity of the built-in speaker of an iPad, tablet computer or smart phone is limited. Further, people may connect an external amplifier and speaker system to a desk computer, notebook computer, iPad, tablet computer or smart phone to enhance the intensity of the audio output. When connecting an amplifier and speaker system to a desk computer, notebook computer, iPad, tablet computer or smart phone, a transmission cable must be used. Further, when connecting an amplifier and speaker system to a desk computer, notebook computer, iPad, tablet computer or smart phone, a deck or device holder shall be used to hold the desk computer, notebook computer, iPad, tablet computer or smart phone in place. Further, commercial decks and device holders are specifically designed to support one particular design of mobile electronic device.

Therefore, there is a strong demand for deck means that is practical for holding any of a variety of different mobile electronic devices in an operative status.

SUMMARY OF THE INVENTION

The present invention has been accomplished under the circumstances in view. It is the main object of the present invention to provide a sound effect amplification diffuser, which is practical for holding one of a variety of mobile electronic devices and enhancing the intensity of the output sound of the loaded mobile electronic device.

To achieve this and other objects of the present invention, a sound effect amplification diffuser comprises a deck for holding a mobile electronic device, and an amplification diffuser for enhancing the intensity of the output sound of the mobile electronic device being carried on the deck. The deck comprises a base member, and a cover member covering the base member and defining an accommodation chamber between the base member and the cover member. The cover member is affixed to the cover member of the deck in the accommodation chamber and connected between the sound hood and the sound grille for enhancing the intensity of the output sound of the mobile electronic device being positioned in the bearing space of the deck.

Further, an elongated locating groove is disposed in the bearing space of the cover member for holding a mobile electronic device in the bearing space in vertical. Further, the cover member comprises a recessed sloping top wall defining the bearing space suitable for holding an iPad or any of a variety of other tablet computers and smart phone.

DETAILED DESCRIPTION OF THE PREFERRED EMBODIMENT

Figure 1:
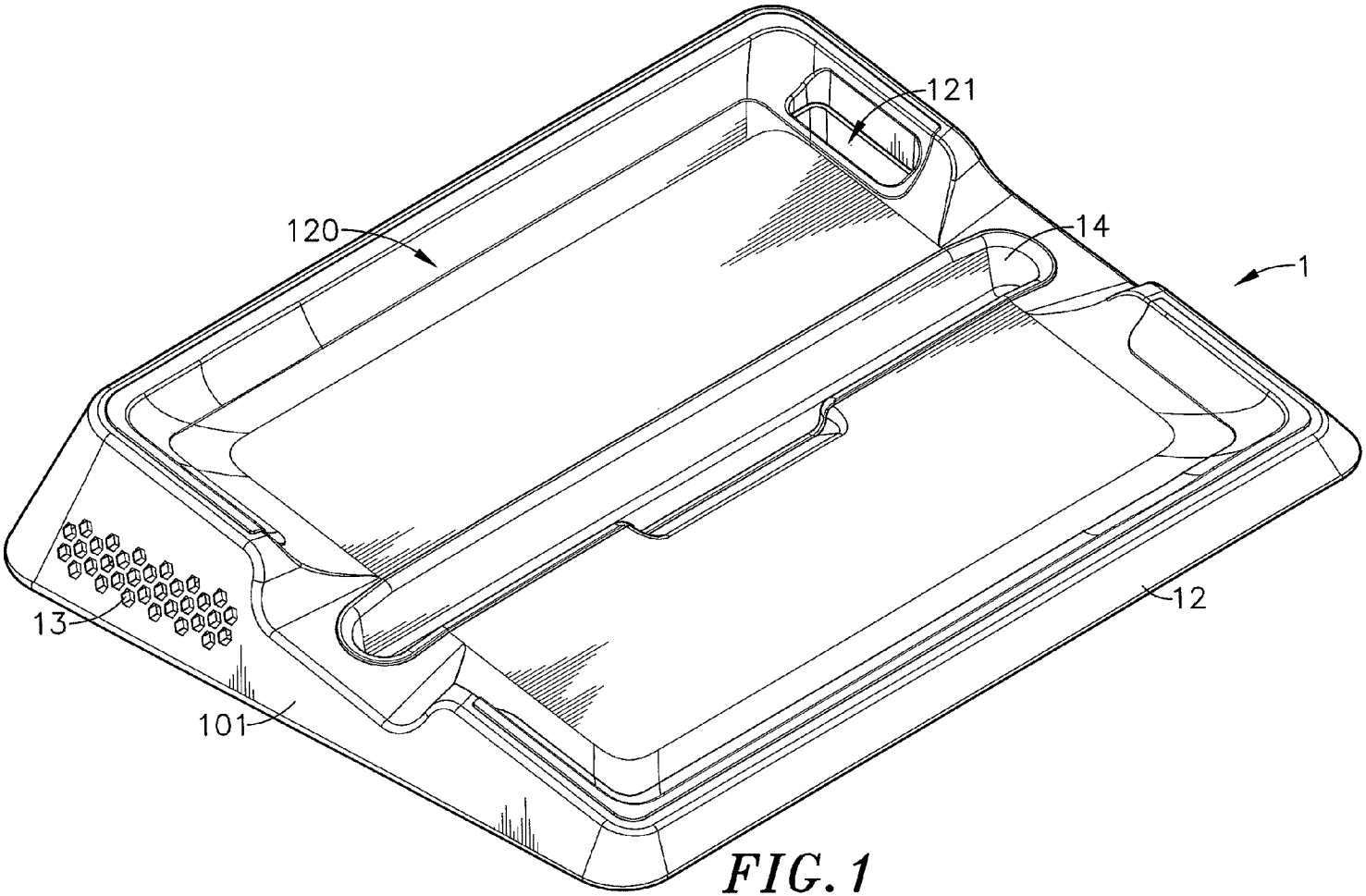
FIG. 1 is an elevational view of a sound effect amplification and diffusing device in accordance with the present invention.
Figure 2:
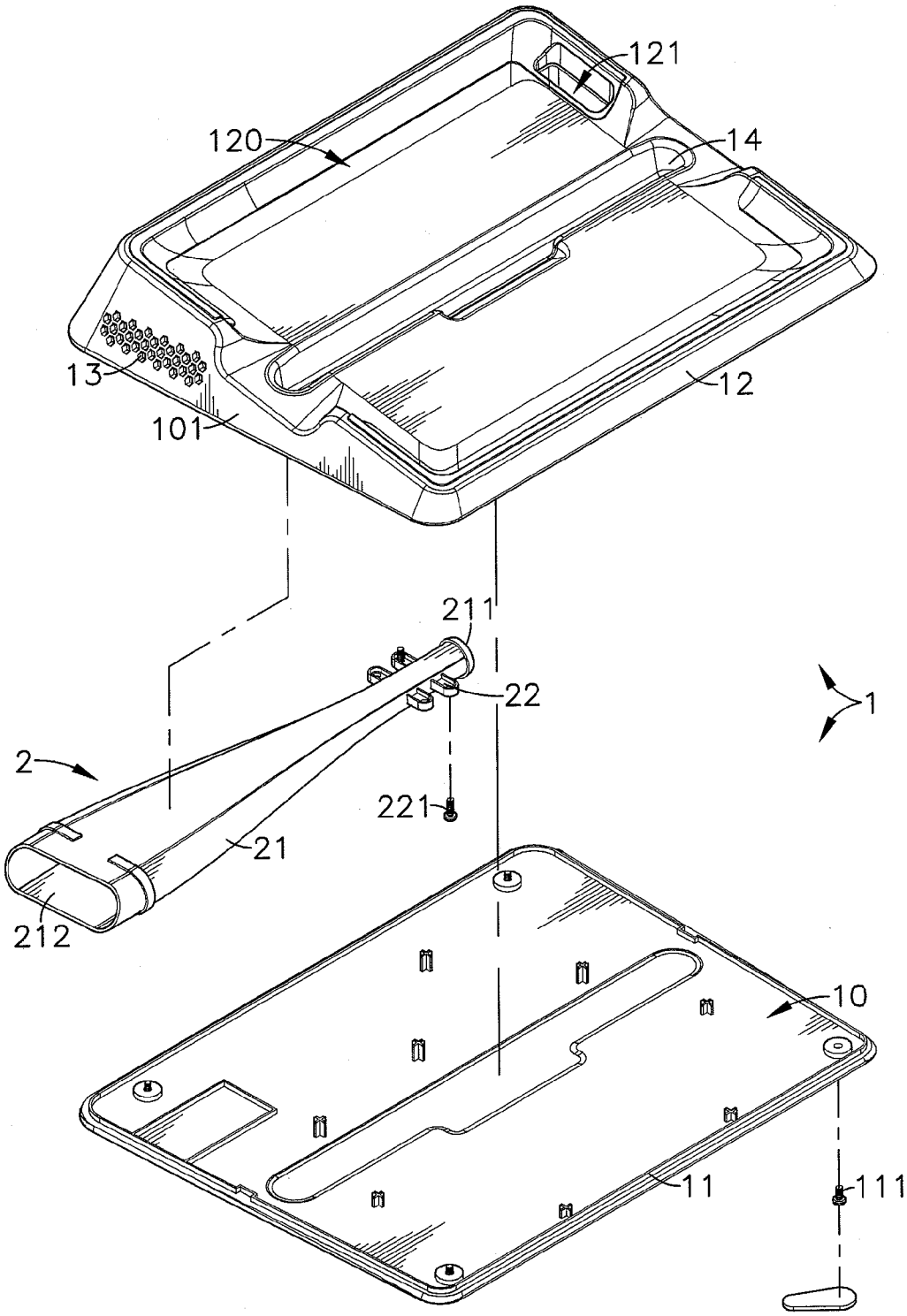
FIG. 2 is an exploded view of the sound effect amplification and diffusing device in accordance with the present invention.
Figure 3:
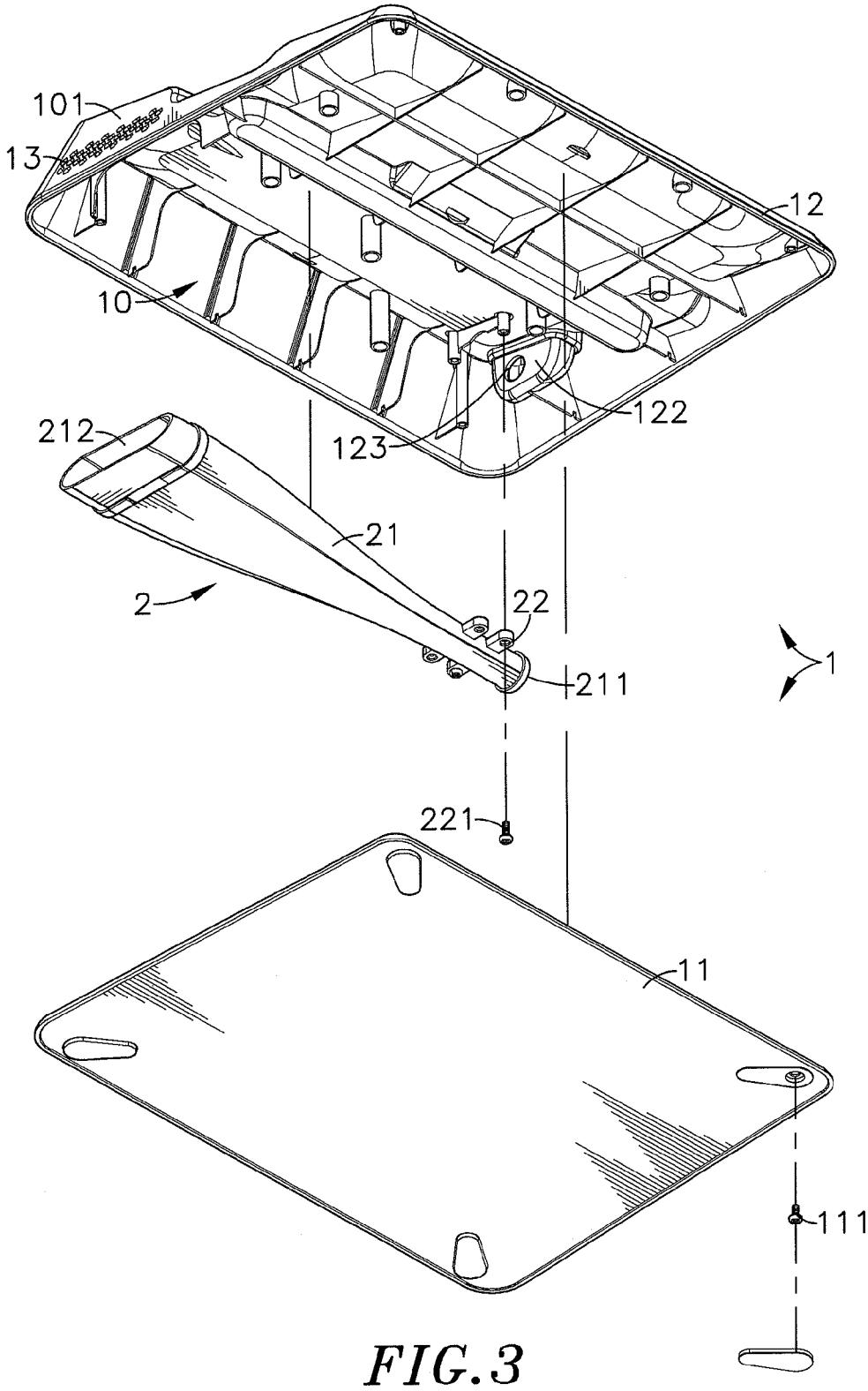
FIG. 3 corresponds to FIG. 2 when viewed from another angle.
Figure 4:
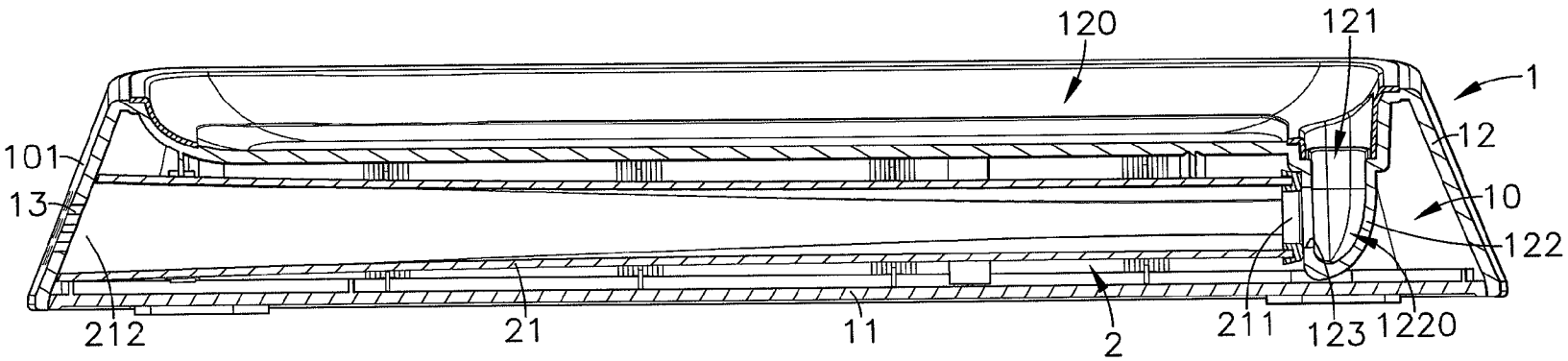
FIG. 4 is a sectional side view of the sound effect amplification and diffusing device in accordance with the present invention.

Referring to FIGS. 1-4, a sound effect amplification diffuser in accordance with the present invention is shown. The sound effect amplification diffuser comprises a deck 1, and an amplification diffuser 2.

The deck 1 comprises a base member 11, a cover member 12 covering the base member 11, an accommodation chamber 10 defined in between the base member 11 and the cover member 12, a plurality of screw nails 111 fastened to respective corner areas of the base member 11 and the cover member 12 to affix the base member 11 and the cover member 12 together. The cover member 12 has a recessed sloping top wall defining a bearing space 120, a sound collection hole 121 cut through the opposing top and bottom walls thereof and disposed at one lateral side of the bearing space 120, a sound collecting hood 122 mounted at the bottom wall thereof around the sound collection hole 121 and suspending in the accommodation chamber 10, a sound chamber 1220 defined in the sound collecting hood 122 in communication with the sound collection hole 121, a sound outlet 123 located at one side of the sound collecting hood 122 in communication between the sound chamber 1220 and the accommodation chamber 10, and a sound grille 13 located at one side wall 101 thereof opposite to the sound collection hole 121 and kept in communication between the accommodation chamber 10 for the passing of sound.

The amplification diffuser 2 comprises a trumpet-like sound guide body 21, a connection hole 211 located at one end of the trumpet-like sound guide body 21 and connected to the sound outlet 123 at the cover member 12 of the deck 1, a horn mouth 212 located at an opposite end of the trumpet-like sound guide body 21 in communication with the connection hole 211, and a mounting structure 22 located at the periphery adjacent to the connection hole 211.

When assembling the sound effect amplification diffuser, attach the connection hole 211 of the amplification diffuser 2 to the sound outlet 123 of the sound collecting hood 122 at the cover member 12 of the deck 1 and the horn mouth 212 of the amplification diffuser 2 to the inner side of the sound grille 13 located at one side wall 101 of the cover member 12 of the deck 1, and then affix the mounting structure 22 of the amplification diffuser 2 to the bottom wall of the cover member 12 of the deck 1 by screw nails 231 (or rivets or an adhesive), and then affix the base member 11 of the deck 1 to the cover member 12 by screw nails 111, keeping the amplification diffuser 2 in the accommodation chamber 10 in between the base member 11 and the cover member 12.

Figure 5:
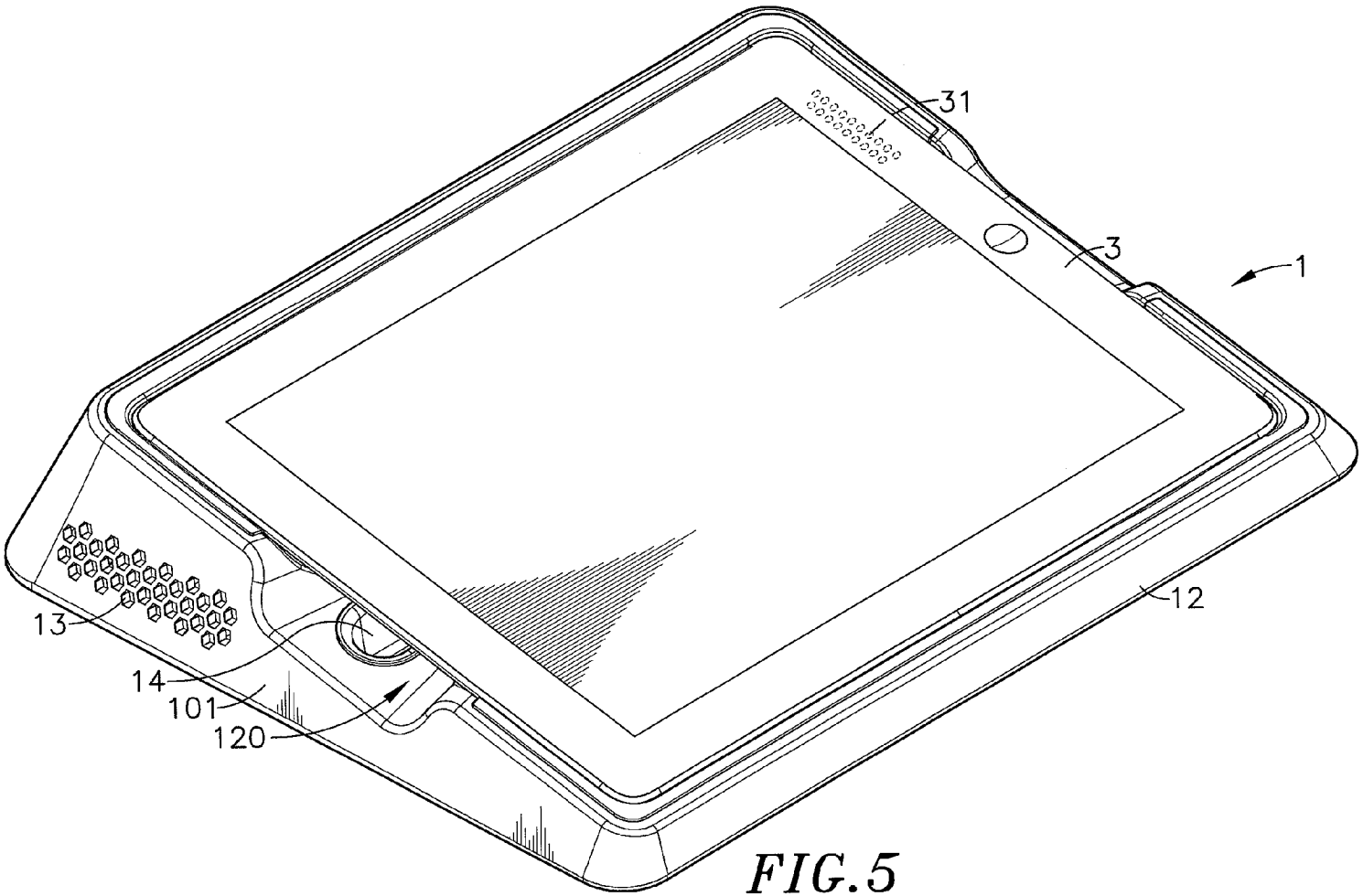
FIG. 5 is an applied view of the present invention, illustrating a tablet computer positioned in the bearing space of the deck in horizontal.
Figure 6:
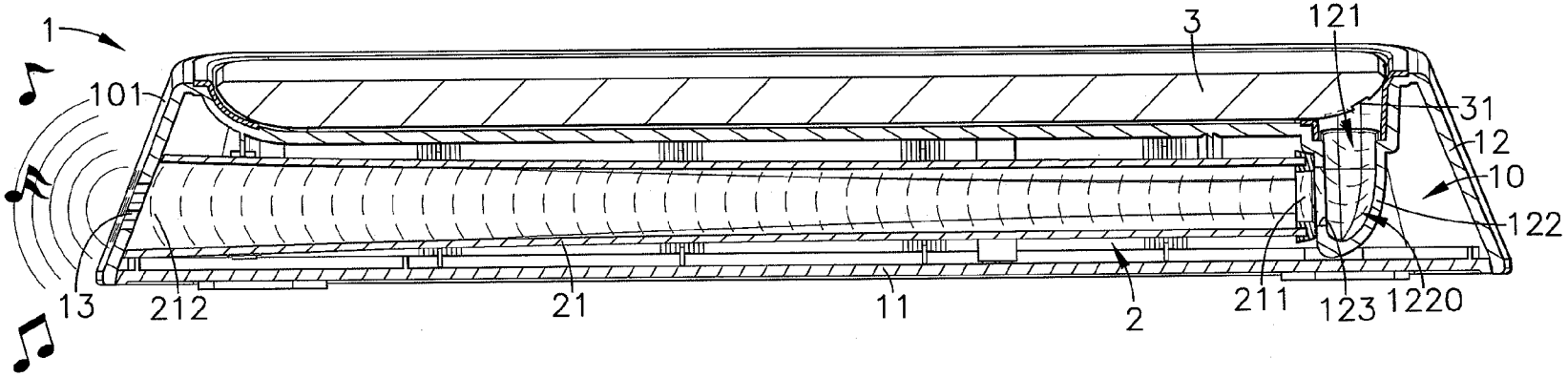
FIG. 6 is a schematic sectional side view of FIG. 5, illustrating sound waves outputted from the tablet computer though the amplification diffuser.
Figure 7:
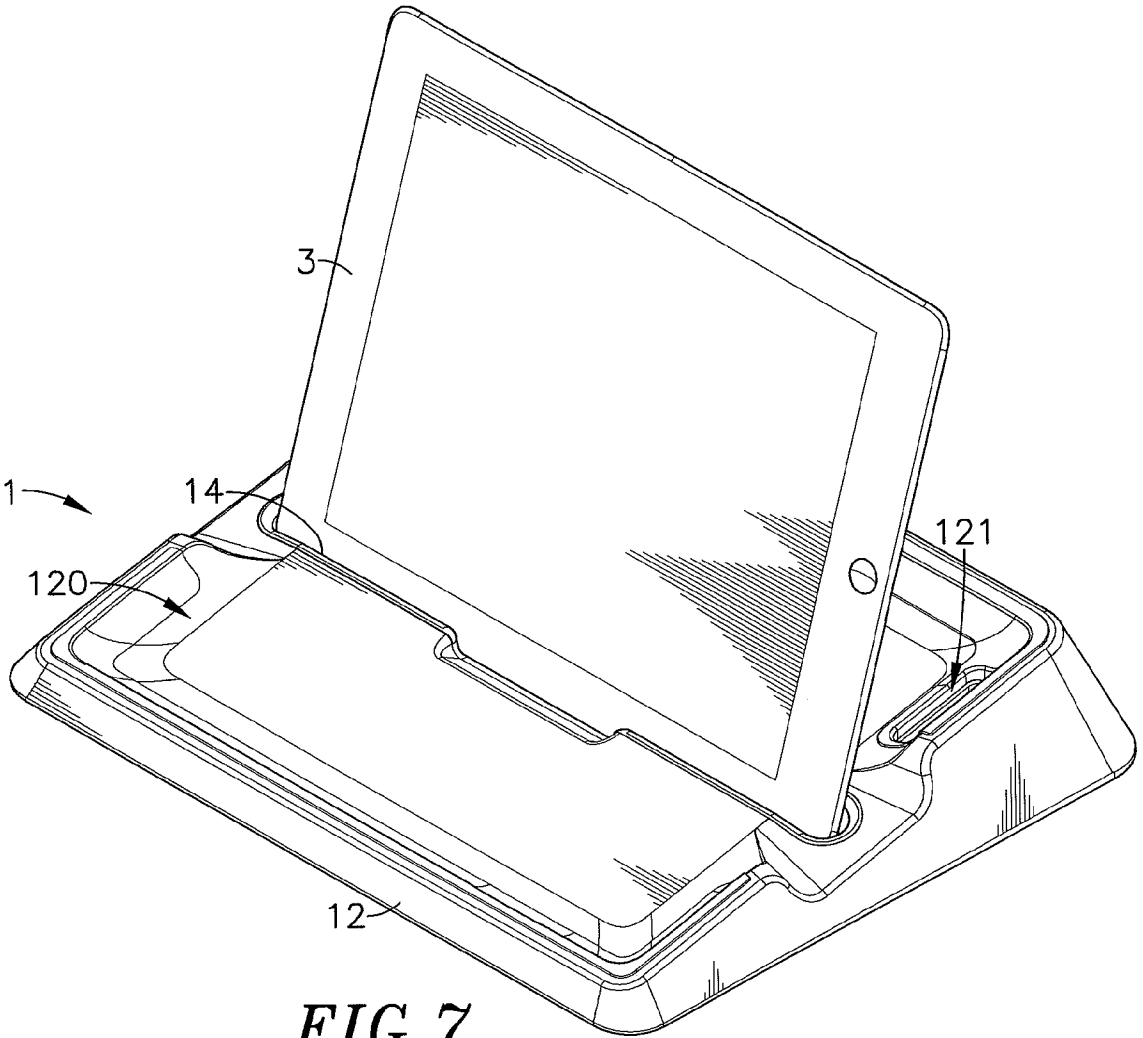
FIG. 7 is another applied view of the present invention, illustrating a tablet computer positioned in the bearing space of the deck in vertical.

Referring to FIGS. 5-7 and FIGS. 2 and 3 again, during application of the sound effect amplification diffuser, a mobile electronic device 3 (iPad, other tablet computer or smart phone) can be positioned in the bearing space 120 at the top side of the cover member 12 of the deck 1 steadily and then operated to run a software program or any particular function. Further, an elongated locating groove 14 is formed in the bearing space 120 and configured subject to the cross-sectional size of one predetermined mobile electronic device 3 for holding this predetermined mobile electronic device 3 in the bearing space 120 at the top side of the cover member 12 of the deck 1 steadily in vertical.

Further, the bearing space 120 at the top side of the cover member 12 of the deck 1 is configured to fit different mobile electronic devices 3. When putting a mobile electronic device 3 in the bearing space 120, keep the speaker 31 of the mobile electronic device 3 in proximity to the sound collection hole 121 of the cover member 12 of the deck 1. When the mobile electronic device 3 is playing a music or video file, sound waves outputted by the mobile electronic device 3 go through the sound collection hole 121 of the cover member 12 into the sound chamber 1220 in the sound collecting hood 122, and then go through the sound outlet 123 of the sound collecting hood 122 toward the outside of the sound effect amplification diffuser via the horn mouth 212 of the trumpet-like sound guide body 21 and the sound grille 13 of the cover member 12 of the deck 1. When wound waves pass through the trumpet-like sound guide body 21 of the amplification diffuser 2, a resonance effect is produced to enhance the intensity of sound. Thus, subject to the design of the bearing space 120 at the top side of the cover member 12 of the deck 1 and the arrangement of the amplification diffuser 2 in the deck 1, the sound effect amplification diffuser can hold a mobile electronic device 3 steadily in place and enhance the intensity of the output sound of the mobile electronic device 3.

In actual application of the present invention, the sound effect amplification diffuser provides the following features and advantages:

1. Subject to the arrangement of the amplification diffuser 2 in the deck 1 to keep the connection hole 211 of the amplification diffuser 2 in communication with the sound outlet 123 of the sound collecting hood 122 at the cover member 12 of the deck 1 and the horn mouth 212 of the amplification diffuser 2 in communication with the sound grille 13 located at one side wall 101 of the cover member 12 of the deck 1, the sound effect amplification diffuser can hold a mobile electronic device 3 steadily in the bearing space 120 at the top side of the cover member 12 of the deck 1 and enhance the intensity of the output sound of the mobile electronic device 3.
2. The bearing space 120 at the top side of the cover member 12 of the deck 1 is configured to fit different mobile electronic devices 3 so that any of a variety of mobile electronic device 3 can be positioned in the bearing space 120 at the top side of the cover member 12 of the deck 1 steadily, enabling the intensity of its output sound to be enhanced.

In general, the invention provides a sound effect amplification diffuser, which comprises a deck, which comprises a cover member, which defines a bearing space at the top side thereof, a sound collection hole at one lateral side of the bearing space, a sound collecting hood at the bottom side thereof around the sound collection hole, a sound outlet at one side of the sound collecting hood and a sound grille at one side wall thereof, a base member affixed to the bottom side of the cover member and an accommodation chamber defined in between the base member and the cover member, and an amplification diffuser, which comprises a trumpet-like sound guide body suspending in the accommodation chamber of the deck, a connection hole located at one end of the trumpet-like sound guide body connected to the sound outlet at the cover member of the deck, a horn mouth located at an opposite end of the trumpet-like sound guide body and connected to the sound grille of the deck. Subject to the design of the deck and the arrangement of the amplification diffuser in the deck, the sound effect amplification diffuser can hold a mobile electronic device steadily in the bearing space at the top side of the cover member of the deck and enhance the intensity of the output sound of the mobile electronic device.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A sound effect amplification diffuser, comprising:

a deck comprising a base member, a cover member covering said base member, and an accommodation chamber defined in between said base member and said cover member, said cover member comprises a bearing space defined in a top side thereof, a sound collection hole cut through opposing top and bottom walls thereof and disposed at one lateral side of said bearing space, a sound collecting hood mounted at a bottom side thereof around said sound collection hole and suspending in said accommodation chamber, a sound chamber defined in said sound collecting hood in communication with said sound collection hole, a sound outlet located at one side of said sound collecting hood in communication between said sound chamber and said accommodation chamber, and a sound grille located at one side wall thereof opposite to said sound collection hole and kept in communication between said accommodation chamber; and an amplification diffuser affixed to said cover member of said deck and suspending in said accommodation chamber, said amplification diffuser comprising a trumpet-like sound guide body, a connection hole located at one end of said trumpet-like sound guide body and connected to said sound outlet of said cover member, and a horn mouth located at an opposite end of said trumpet-like sound guide body in air communication with said connection hole and said sound grille.

2. The sound effect amplification diffuser as claimed in claim 1, wherein said bearing space of said cover member is configured for holding one of different mobile electronic devices including tablet computers and smart phones in horizontal.

3. The sound effect amplification diffuser as claimed in claim 1, wherein said cover member comprises a recessed sloping top wall defining said bearing space.

4. The sound effect amplification diffuser as claimed in claim 1, wherein said cover member further comprises an elongated locating groove disposed in said bearing space for holding one said mobile electronic device in said bearing space in vertical.

5. The sound effect amplification diffuser as claimed in claim 1, wherein said cover member and said base member of said deck are fixedly fastened together by screw nails.

6. The sound effect amplification diffuser as claimed in claim 1, wherein the diameter of said connection hole at one end of said trumpet-like sound guide body is smaller than the diameter of said horn mouth.

* * * * *